United States Patent [19]

Iimuro et al.

[11] 4,058,967

[45] Nov. 22, 1977

[54] TEXTURED POLYESTER MULTIFILAMENT YARN

[75] Inventors: Hiroyuki Iimuro; Takumi Horiuchi; Yoji Kuroda; Kikuo Hori, all of Matsuyama; Tatumi Kawano, Iyo-gun, all of Japan

[73] Assignee: Teijin Limited, Osaka, Japan

[21] Appl. No.: 679,323

[22] Filed: Apr. 22, 1976

[30] Foreign Application Priority Data

| | | |
|---|---|---|
| May 8, 1975 | Japan | 50-54247 |
| Oct. 20, 1975 | Japan | 50-125341 |
| Oct. 20, 1975 | Japan | 50-125342 |

[51] Int. Cl.[2] ..... D02G 3/34

[52] U.S. Cl. ..... 57/140 J; 428/397

[58] Field of Search ..... 57/140 J, 157 R, 157 S, 57/157 TS, 157 MS; 428/397

[56] References Cited

U.S. PATENT DOCUMENTS

| | | | |
|---|---|---|---|
| 3,109,220 | 11/1963 | McKinney et al. | 428/397 X |
| 3,425,893 | 2/1969 | Sims | 57/140 J X |
| 3,508,390 | 4/1970 | Bagnall et al. | 57/140 J |
| 3,551,279 | 8/1968 | Ando et al. | 428/397 X |
| 3,691,749 | 9/1972 | McKay | 57/140 J |
| 3,802,177 | 4/1974 | Sekiguchi et al. | 57/140 J X |
| 3,846,969 | 11/1974 | McKay | 57/157 TS X |

*Primary Examiner*—Donald Watkins

*Attorney, Agent, or Firm*—Burgess, Ryan and Wayne

[57] ABSTRACT

Textured polyester multifilament yarns usable for producing knitted or woven fabrics having a desirable dyeing property but no objectionable appearance of local glitter, are prepared, with high efficiency, by simultaneously drawing and false-twist texturing an undrawn polyester multifilament feed yarn composed of a plurality of polyester filaments each having a multilobal cross-sectional profile having 5 to 10 lobes projected radially with substantially equal angular intervals therebetween about the center of the filament, the cross-sectional profile satisfying the relationship (1)

$$1.05 \leqq R_1/R_0 \leqq 1.16 \quad (1)$$

wherein $R_0$ is the radius of an imaginary circle inscribed within the cross-section around the center of the filament and $R_1$ is the radius of another imaginary circle circumscribed about the tips of at least half the total number of the lobes, around the center of the filament.

14 Claims, 10 Drawing Figures

TEXTURED POLYESTER MULTIFILAMENT YARN

The present invention relates to a process for producing textured polyester multifilament yarn having a multilobal cross-sectional profile. More particularly, the present invention relates to a process for producing textured polyester multifilament yarn capable of being converted into knitted or woven fabrics which have a desirable dyeing property but no objectionable local glitter. Recently, a process has been developed for producing textured polyester multifilament yarns by simultaneously drawing and false-twist texturing undrawn polyester multifilaments which have been produced by melt-spinning at an extremely high take-up speed and have a relatively high degree of molecular orientation. The conventional textured polyester yarns prepared in accordance with this process, however, have a disadvantage in that in the process in which the undrawn polyester feed yarn is simultaneously drawn and false-twisted, the cross-sectional profiles of the individual polyester filaments constituting the yarn are remarkably deformed (flattened).

When the conventional textured polyester multifilament yarns prepared by the above-mentioned process, are converted into a woven or knitted fabric, the flattened cross-sectional profiles of the individual filaments result in undesirable spot-like glitter or sparkle (glaze) on the woven or knitted fabric. Such woven or knitted fabric are not suitable for garments, especially, men's suits.

As means for overcoming the above-mentioned disadvantage, it has been proposed in, for example, Japanese Patent Applications Laying-open Nos. 26557/74 and 36950/74 to utilize polyester multifilaments having an irregular (non-circular) cross-sectional profile, for instance, a triangular, square or pentagonal cross-sectional profile, for producing the woven or knitted fabrics. However, polyester multifilaments having the conventional irregular cross-sectional profiles have the following disadvantages.

1. Even when a woven or knitted fabric is prepared from the textured polyester multifilaments having the conventional irregular cross-sectional profile, it is difficult to completely prevent the undesirable appearance of glitter in the resultant fabric, because the irregular cross-sectional profiles are still deformed (flattened) by the draw-texturing process.

2. When a woven or knitted fabric which has been prepared from the textured polyester multifilaments having the conventional irregular cross-sectional profile is dyed, the dyed fabric has an undesirable watery color and pastel shade, because diffused reflection of light occurs on the surfaces of the multifilaments having the irregular cross-sectional profile.

3. Since the degree of deformation (flattening) of the irregular cross-sectional profile of the multifilaments by the draw-texturing process is not uniform, the woven or knitted fabric prepared from the textured multifilaments has an undesirable non-uniform feel.

4. In the case where the undrawn polyester multifilaments having the conventional irregular cross-sectional profile, for example, triangular, square and pentagonal cross-sectional profiles, are produced by a melt-spinning process at a certain take-up speed, the degree of molecular orientation of the undrawn filaments is more enhanced than in the case of undrawn polyester multifilaments having the regular (circular) cross-sectional profile prepared by the same process. Accordingly, the draw ratio usable for the former in the step of simultaneous drawing and false-twist texturing is lower than that for the latter. This results in a lower efficiency in the manufacture of textured yarn from the former than from the latter.

5. The undrawn polyester multifilaments having the conventional irregular cross-sectional profile have a lower silk factor than those having the regular cross sectional profile and also have a definite tendency toward frequency breakages of yarns of filaments and the formation of fluffs during the simultaneous drawing and false-twist texturing process. Further, the resultant textured polyester multifilament yarns are often poor in tensile strength and elongation at break.

The inventors have conducted research with a view to overcoming the foregoing defects and disadvantages involved in the conventional textured polyester multifilament yarn. As a result, the inventors have found that if the cross-sectional profiles of the undrawn polyester multifilaments are modified to have a specific multilobal profile, the above-mentioned defects and disadvantages can be overcome and textured polyester multifilament yarns of good quality can be obtained from the undrawn filaments having the specific multilobal cross-sectional profile. An object of the present invention is to provide a process for producing textured polyester multifilament yarns useful for producing knitted or woven fabrics having a desirable good dyeing property but no objectionable appearance of local glitter.

The other object of the present invention is to provide a process for producing a textured polyester multifilament yarns with a high efficiency of production.

The above objects can be attained by the process of the present invention, which comprises simultaneously drawing and false-twist texturing an undrawn polyester multifilament feed yarn composed of a plurality of polyester filaments each having a multilobal cross-sectional profile having 5 to 10 lobes projected radially with substantially equal higher intervals therebetween about the center of the filament, said cross-sectional satisfying the following relationship (1):

$$1.05 \leqq R_1/R_0 \leqq 1.16 \qquad (1)$$

wherein $R_0$ represents the radius of an imaginary circle inscribed within said cross-section around the center of the filament, $R_1$ represents the radius of another imaginary circle circumscribed about the tips of lobes of at least half the total number of said lobes around the center of the filament.

The undrawn polyester multifilaments usable for the process of the present invention consist of a polyester containing at least 80% by mole of ethylene terephthalate units. As the polyester usable for the present invention, polyethylene terephthalate is preferred. However, copolymers containing 20% by mole or less, preferably, 10% by mole or less, of a third component other than the ethylene terephthalate units are also usable for the present invention. As preferred examples of the third component, there can be mentioned dicarboxylic acid such as isophthalic acid, naphthalene-2,6-dicarboxylic acid, adipic acid and 5-sodium-sulfoisoisophthalic acid, and diols such as trimethylene glycol and tetramethylene glycol.

The undrawn polyester multifilament yarns mentioned above may be composed of either completely undrawn filaments which have been melt-spun at a take-up speed of 2500 m/min or lower or so-called partially oriented undrawn filaments which have been melt-spun at a take-up speed of 2500 to 4000 m/min, and preferably have an elongation at break of about 90 to about 230%.

The undrawn polyester multifilaments may contain a delustering agent such as titanium dioxide. In the undrawn polyester multifilaments of the present invention, even when the delustering agent is used in a smaller amount than the amount used in regular dull or semi-dull filaments, namely, 0.10 to 0.35% by weight, the resultant textured multifilaments can be sufficiently delustered. Further, the textured polyester multifilaments can be dyed a clearer color due to the smaller content of the delustering agent therein.

In the process of the present invention, it is preferable that the denier of the undrawn individual filaments be adjusted so that the denier of the textured individual filaments becomes 2 to 7, more preferably, 2 to 5, after the simultaneous drawing and texturing process. That is, it is preferable that the denier of the individual filament in the undrawn polyester multifilament yarn be in a range from 2.5 to 9.0, more preferably, from 2.8 to 8.0. Further, in the present invention, it is preferable that the total denier of the undrawn polyester multifilament yarn be in a range from 40 to 450, more preferably, from 55 to 240, and the total denier of the drawn and textured polyester multifilament yarn be in a range from 30 to 300, more preferably, 40 to 160.

As is stated hereinbefore, the cross-sectional profile of the undrawn polyester multifilaments of the present invention has 5 to 10 lobes projected radially with substantially equal angular intervals about the center of the filament. Generally speaking, it is well-known that as the take-up speed in the melt-spinning process is increased, the stability of winding operation for the spun undrawn multifilament yarn becomes worse. As a result of the inventor's research, it was found that the winding stability at a high winding speed of 2500 m/min or more is much better in undrawn multifilaments having a multilobal cross-sectional profile ocasionally including a small number (for example, less than 4) of relatively large lobes than in undrawn multifilaments having the regular (circular) cross-sectional profile.

However, the textured multifilaments obtained by the simultaneously drawing and false twist texturing of the undrawn multifilaments having the cross-sectional profile with less than 5 lobes, that is, a trilobal and criss-cross cross-sectional profile, and defective in that undesirable local glitter is conspicuous when yarns therefrom are woven or knitted into fabrics. Another defect is in that when the multifilaments having a cross-sectional profile with less than 5 lobes are prepared by way of melt-spinning, the resultant undrawn multifilaments have an excessively high degree of molecular orientation. Such excessively high orientation results in a reduction of the manufacturing efficiency of the undrawn multifilaments.

Compared with this, when the undrawn polyester multifilaments have a multilobal cross-sectional profile with 5 to 10 lobes, and the lobes of at least half the total number of the lobes satisfies the relationship (1):

$$1.05 \leqq R_1/R_0 \leqq 1.16$$

wherein $R_0$ and $R_1$ are as defined hereinbefore, respectively, the undrawn polyester multifilaments have a high winding stability and a proper degree of molecular orientation. Further, this type of undrawn multifilaments can prevent the appearance of undesirable glitter and the objectionable watery color and pastel shade on knitted or woven fabric prepared therefrom.

In the cross-sectional profile mentioned above, if the ratio $R_1/R_0$ is smaller than 1.05, the undrawn multifilaments have a relatively low winding stability. Such low winding stability results in a decrease in the maximum take-up amount of the undrawn multifilaments. Further, it was observed by the inventor that a ratio $R_1/R_0$ smaller than 1.05 causes a relatively conspicuous appearance of local glitter on woven or knitted fabrics. When the ratio $R_1/R_0$ exceeds 1.16, an undesirable watery color and pastel shade is obtained in the dyed woven or knitted fabric. Further, it was observed by the inventor that a ratio $R_1/R_0$ exceeding 1.16 results in an undesirable lower draw ratio being attainable for the undrawn multifilaments and lower manufacturing efficiency.

If the number of the lobes satisfying the relationship (1) $1.05 \leqq R_1/R_0 \leqq 1.16$ is less than half the total number of the lobes, the resultant undrawn multifilaments have a poor winding stability at the high winding speed of 2500 m/min or more and the woven or knitted fabrics prepared therefrom have the undesirable appearance of local glitter. Accordingly, when the total number of the lobes is 5, 6, 7, 8, 9 or 10, the minimum number of the lobes satisfying the relationship (1) is 3, 3, 4, 4, 5 or 5, respectively, and the maximum number of the lobes not satisfying the relationship (1) is 2, 3, 3, 4, 4 or 5, respectively.

In a case where all of the lobes have an equal length, all of the tips of the lobes are circumscribed by the imaginary circle of the radius $R_1$.

In the case where the cross-sectional profile has one or more lobes other than the lobes satisfying the relationship (1) $1.05 \leqq R_1/R_0 \leqq 1.16$, it is preferable that the other lobes satisfy the relationship (2)

$$1.05 \leqq R_2/R_1 \leqq 1.20 \qquad 2$$

wherein $R_1$ is as defined hereinbefore and $R_2$ represents the radius of the other imaginary circle circumscribed about the tips of the other lobes around the center of the filament.

The lobes satisfying the relationship (2) are effective for increasing the winding stability of the undrawn multifilaments.

The features of the present invention will be further illustrated in detail with reference to the accompanying drawings, in which.

Figure 1:
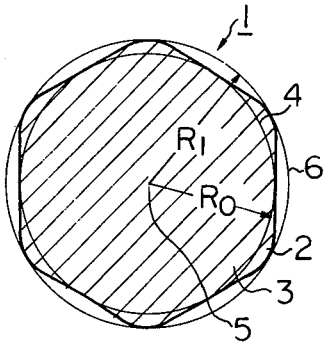
FIGS. 1 and 2 are a cross-sectional view of an embodiment of the polyester filament usable for the present invention, respectively.

Referring to FIG. 1, a cross-sectional profile 1 of a polyester filament is composed of six lobes 2 and a base portion 3. In the drawing, $R_0$ represents the radius of an imaginary circle 4 inscribed within the cross-section 1 around the center 5 of the filament, and $R_1$ represents the radius of an imaginary circle 6 circumscribed about the tips of the lobes 2 around the center 5 of the filament. In the cross-sectional profile of FIG. 1, all of six lobes 2 are substantially equal in size to each other and are arranged symmetrically. However, in the present invention, the lobes may be not equal in size to each other.

Figure 2:
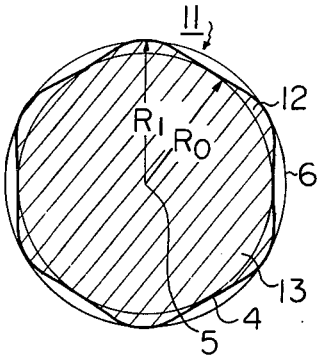

Referring to FIG. 2, the cross-sectional profile 11 consists of six lobes 12 and a base portion 13. The six lobes 12 are different in size from each other.

Figure 3:
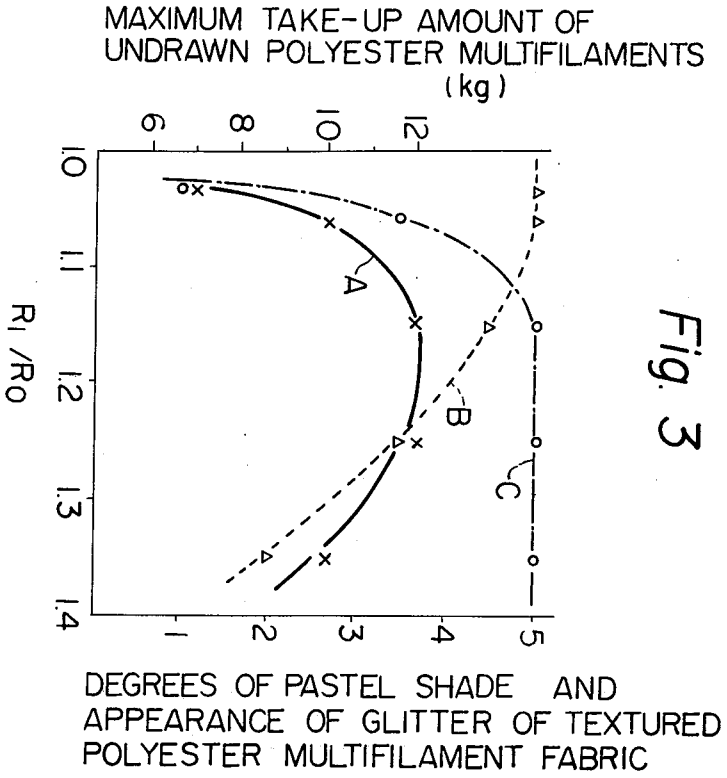
FIG. 3 is a diagram showing relationships of the ratio $R_1/R_0$ to the maximum take-up amount of the undrawn polyester multifilaments of FIG. 1 wound on a bobbin at a winding speed of 3500 m/min, and the degrees of appearance of glitter and pastel shade of a fabric prepared from the textured polyester multifilaments of the present invention.

FIG. 3 shows the relationships of the ratio $R_1/R_0$ to the properties of the undrawn polyester multifilaments of FIG. 1, and a fabric which has been prepared from the textured polyester multifilaments produced from the undrawn polyester multifilaments of FIG. 1. The undrawn polyester multifilament yarn was prepared by melt-spinning polyethylene terephthalate at a take-up speed of 3500 m/min and had a fineness of 222 denier/30 filaments. In FIG. 3, a curve A indicates a relation of the ratio $R_1/R_0$ to the maximum take-up amount of the undrawn polyester multifilaments having the hexalobal cross-sectional profile usable for the present invention and curves B and C indicate relations of the ration $R_1/R_0$ to the degrees of pastel shade and appearance of glitter respectively, of a fabric which has been produced from the textured multifilaments prepared from the hexalobal undrawn polyester multifilaments mentioned above. From FIG. 3, it is seen that it is preferable that the ratio $R_1/R_0$ be in a range from 1.05 to 1.16, more preferably, from 1.06 to 1.16.

In the case where an undrawn polyester multifilament having a hexalobal cross-sectional profile has been melt-spun at a take-up speed of 2800 to 3500 m/min, it is preferable that the undrawn multifilaments be drawn at a draw ratio of 1.3 to 1.8 and textured at a heat-setting temperature of 160° to 220° C.

Figure 4:
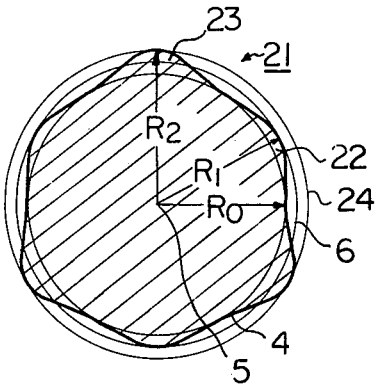
FIG. 4 is a cross-sectional view of another embodiment of the polyester filaments usable for the present invention.

Referring to FIG. 4, a cross-sectional profile 21 of a polyester filament of the present invention has three lobes 22 and another three lobes 23 which are larger than the lobes 22. In the drawing, the three lobes 22 satisfy the relationship (1): $1.05 \leqq R_1/R_0 \leqq 1.16$. That is, an imaginary circle 4 having a radius $R_0$ is inscribed within the cross-section 21 around the center 5 of the filament and an imaginary circle 6 having a radius $R_1$ is circumscribed about the tips of lobs 22 around the center 5 of the filament. However, the three lobes 23 are outside the above relationship (1). In the drawing, $R_2$ represents the radius of an imaginary circle 24 circumscribed about the tips of the three lobes 23 around the center 5 of the filament. In this case, the ratio $R_2/R_1$ satisfies the relationship (2):

$$1.05 \leqq R_2/R_1 \leqq 1.20 \qquad 2$$

Figure 5:
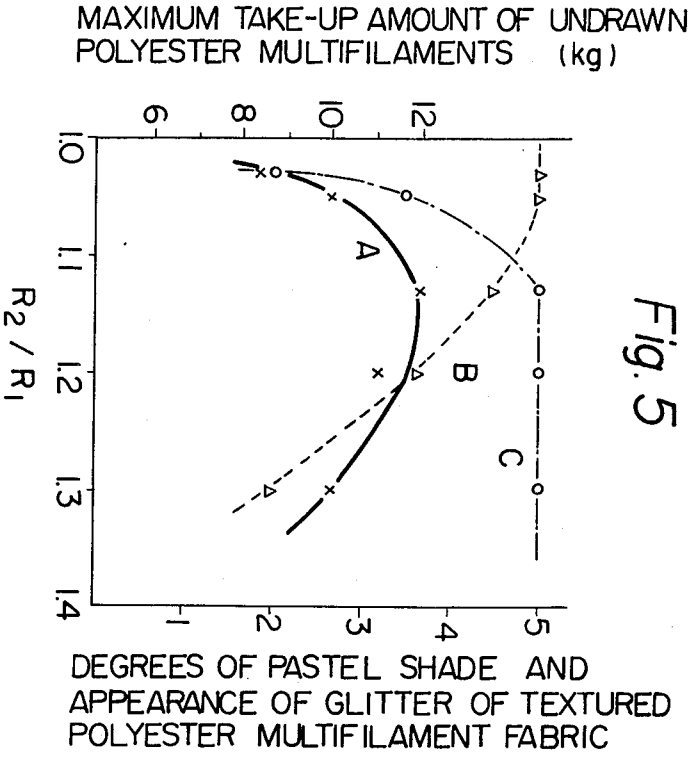
FIG. 5 is a diagram showing relationships of the ratio $R_2/R_1$ to the maximum take-up amount of the undrawn polyester multifilaments of FIG. 4 wound on a bobbin and the degrees of appearance of glitter and pastel shade of a fabric prepared from the textured polyester multifilaments of the present invention.

In FIG. 5, a curve A indicates a relation of the ratio $R_1/R_0$ to the maximum take-up amount of the undrawn polyester multifilaments having the hexalobal cross-sectional profile usable for the present invention and curves B and C indicate relations of the ratio $R_1/R_0$ to the degrees of pastel shade and appearance of glitter respectively, of a fabric which has been produced from the textured multifilaments prepared from the hexalobal undrawn polyester multifilaments mentioned above. FIG. 5 indicates that when the ratio $R_2/R_1$ is in a range from 1.05 to 1.20, the maximum take-up amount of the undrawn polyester multifilament yarn which has been produced by way of melt-spinning polyethylene terephthalate at a take-up speed of 3500 m/min and has a fineness of 200 denier/48 filaments, and the degrees of the appearance of glitter and pastel shade of the fabric prepared from the textured polyester multifilament yarn of the present invention, are in preferable ranges.

Figure 6:
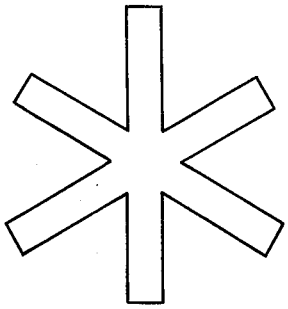
FIG. 6 is an enlarged cross-sectional view of an embodiment of a spinning orifice usable for the undrawn polyester multifilaments having the cross-sectional profile as shown in FIG. 4.

The undrawn polyester multifilaments having the hexalobal cross-sectional profile indicated in FIG. 4 can be prepared by using a spinneret having a plurality, for example, 20 to 60, of spinning orifices including six radially extended slits of different length as indicated in FIG. 6. In this case, the intrinsic viscosity of the starting polyester, the spinning temperature and the cooling temperature of the spun filaments can be appropriately adjusted in consideration of the desired fineness and cross-sectional profile of the undrawn polyester filaments, and the type of melt-spinning apparatus.

The undrawn polyester multifilaments thus prepared and having a elongation at break of 9 to 230% can be drawn at a draw ratio of 1.3 to 1.8 and simultaneously textured at a heat-setting temperature of 160° to 220° C. In order to texture the undrawn polyester multifilaments, a false-twisting spindle is generally used. However, a frictional false-twister of the outer contact or inner contact type can also be used for the present invention.

Figure 7:
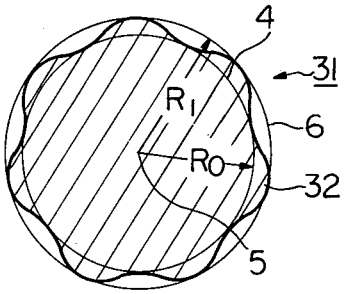
FIG. 7 is a cross-sectional view of another embodiment of the undrawn polyester multifilaments usable for the present invention.

FIG. 7 is a heptalobal cross-sectional view of an undrawn polyester multifilament. That is, the cross-section 31 has seven lobes 32. An imaginary circle 4 having a radius $R_0$ is described within the cross-section and an imaginary circle 6 having a radius $R_1$ is circumscribed about the tips of the seven lobes 32 around the center 5 of the filament.

Figure 8:
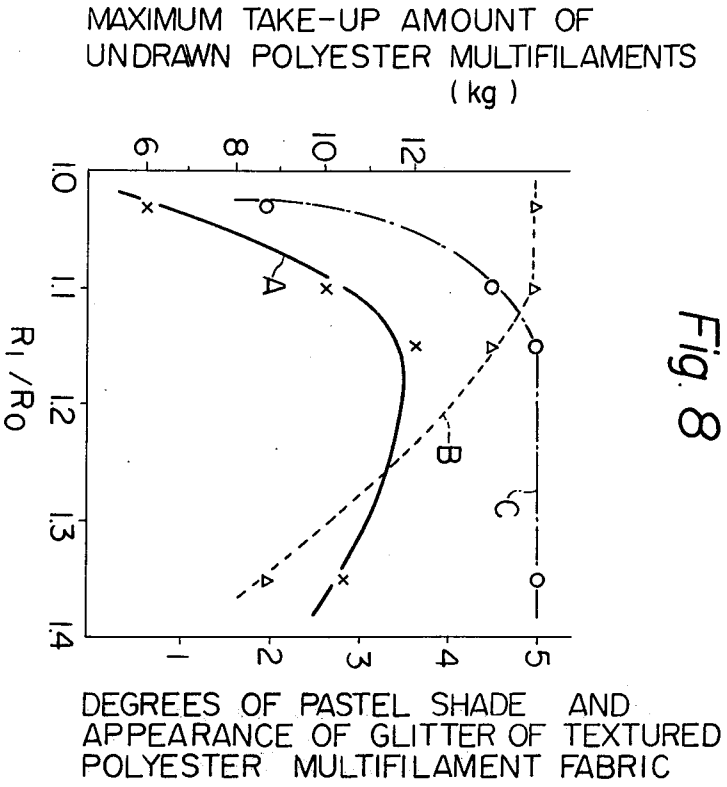
FIG. 8 is a diagram showing relationships of the ratio $R_1/R_0$ to the maximum take-up amount of the undrawn polyester multifilaments of FIG. 7 wound on a bobbin and the degrees of appearance of glitter and pastel shade of a fabric prepared from the textured polyester multifilaments of the present invention.

Referring to FIG. 8, a curve A indicates a relation of the ratio $R_1/R_0$ to the maximum take-up amount of the undrawn polyester multifilaments having the heptalobal cross-sectional profile usable for the present invention, and curves B and C indicate the relations of the ratio $R_1/R_0$ to the degrees of pastel shade and appearance of glitter, respectively, of a fabric which has been prepared from the textured multifilaments converted from the above-mentioned undrawn polyester multifilaments. From FIG. 8, it is seen that it is desirable that the ratio $R_1/R_0$ be in a range from 1.05 to 1.16.

Figure 9:
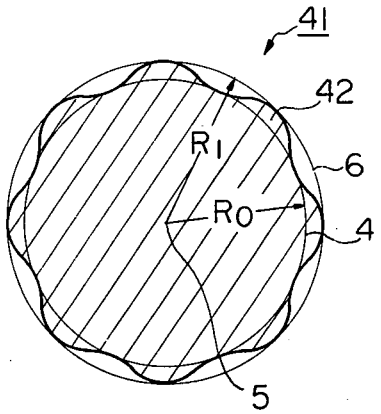
FIG. 9 is a cross-sectional view of the other embodiment of the undrawn polyester multifilaments usable for the present invention.

FIG. 9 shows an octalobal cross-sectional profile of the undrawn polyester multifilaments usable for the present invention. In the drawing, an imaginary circle 4 having a radius $R_0$ is inscribed within the cross section 41, and an imaginary circle 6 having a radius $R_1$ is circumscribed about the tips of eight lobes 42 around the center 5 of the filament.

Figure 10:
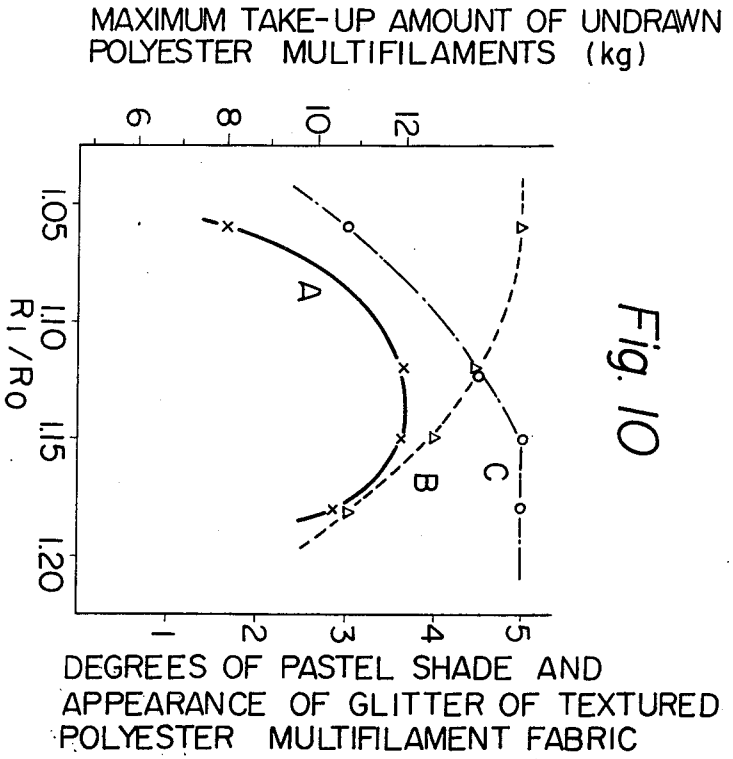
FIG. 10 is a diagram showing relationships of the ratio $R_1/R_0$ to the maximum take-up amount of the undrawn polyester multifilaments of FIG. 9 wound on a bobbin and the degrees of appearance of glitter and pastel shade of the textured polyester multifilaments of the present invention.

In FIG. 10, a curve A indicates a relation of the ratio $R_1/R_0$ to the maximum take-up amount of the undrawn polyester multifilaments having the octalobal cross-sectional profile usable for the present invention and curves B and C indicate relations of the ratio $R_1/R_0$ to the degrees of pastel shade and appearance of glitter respectively, of a fabric which has been produced from the textured multifilaments prepared from the octalobal undrawn polyester multifilaments mentioned above. From FIG. 10, it is seen that it is preferable that the ratio $R_1/R_0$ be in a range from 1.05 to 1.16, more preferably, from 1.10 to 1.16.

Even when the undrawn polyester multifilaments of the present invention are deformed by the simultaneous drawing and texturing, the resultant textured multifilaments have no flat portions causing partial or local reflection of light. This is because of the presence of a number of lobes in the cross-sectional profile of the multifilaments. Accordingly, the fabric prepared from the textured multifilaments has substantially no appearance of glitter. Further, the undesirable appearance of pastel shades due to the diffused reflection of light can be remarkably reduced by the special lobes in the cross-sectional profile and dyed fabrics having a sharp color can be obtained.

Still further, the simultaneous drawing and false-twist texturing operation for the undrawn polyester multifilaments of the present invention can be smoothly carried out and the resultant textured polyester multifilament yarn has good physical properties with reduced fluffs. In addition, the undrawn polyester multifilaments having a specific cross-sectional profile of the present invention can be wound up stably even at a high take-up speed of, for example, 2500 m/min or more, and the maximum take-up amount thereof can be increased.

The following specific examples will serve to more fully explain the practice of the present invention. However, it should be understood that these are only examples and in no way limit the present invention.

EXAMPLES 1 THROUGH 3 and COMPARISON EXAMPLES 1 THROUGH 4

A mixture of 99.8% by weight of polyethylene terephthalate having an intrinsic viscosity of 0.635, which had been measured at a temperature of 35° C in o-chlorophenol, and 0.2% by weight of titanium dioxide was melted at a temperature of 290° C. The melt was extruded through a spinneret having 48 spinning orifices, each with a cross-section as indicated in FIG. 6. The extruded filamentary melts were cooled and solidified by blowing cooling air thereon. The filaments thus produced were oiled and wound on a bobbin at a traverse of 150 mm and a take-up speed of 3500 m/min. The above-mentioned spinning operation was repeated four times in the ratios ($R_1/R_0$) of 1.06, 1.15 and 1.25 (Examples 1 through 3).

In Comparison Examples 1 and 2, the above-mentioned spinning operation was repeated in the ratios ($R_1/R_0$) of 1.03 and 1.35.

In Comparison Example 3, trilobal undrawn multifilaments and in Comparison Example 4, circular undrawn multifilaments were prepared by using the same polymeric mixture as mentioned above under the same melt-spinning conditions as mentioned above.

The undrawn polyester multifilament yarns of Examples 1 through 3 and Comparison Example 1 through 4 were simultaneously drawn and false-twist textured under the following conditions.

Draw ratio : 1.469
Heat-setting temperature : 190° C
Twist number : 2650 T/M
Processing speed : 150 m/min.

The resultant textured yarns had a fineness of 150 denier/48 filaments.

Each of the textured yarns was converted into a woven fabric and the fabric was dyed under the following conditions.

Dye : Amacron Blue RLS (a trademark of C.I. Disperse Blue 70 made by Koppers Company Inc.)
Concentration of Dye : 1.0% based on the weight of fabric
Liquor Ratio : 1:40
Dyeing temperature : 130° C
Dyeing time : 60 minutes.

The results are indicated in Table 1.

Table 1

| Example No. | | Undrawn filaments: Cross-sectional profile | Ratio $R_2/R_1$ | Ratio $R_1/R_0$ | Maximum take-up amount (kg) | Textured filament: Total percentage crimp (TC) (*1) (%) | Number of fluffs per chese | Fabric: Degree of appearance of glitter (*2) (class) | Degree of pastel shade (*3) (class) |
|---|---|---|---|---|---|---|---|---|---|
| Example | 1 | Hexalobal | 1.05 | 1.06 | 10 | 35 | 0–1 | 3.5 | 5 |
| | 2 | " | 1.13 | 1.15 | 12 | 35 | 0–1 | 5 | 4.5 |
| | 3 | " | 1.20 | 1.25 | 11 | 32 | 0–1 | 5 | 3.5 |
| Comparison Example | 1 | Hexalobal | 1.03 | 1.03 | 8.5 | 36 | 3–5 | 2 | 3 |
| | 2 | " | 1.30 | 1.35 | 10 | 28 | 5–10 | 5 | 2 |
| | 3 | Trilobal | — | — | 8 | 29 | 10–15 | 2.5 | 1 |

Table 1-continued

| Example No. | | Undrawn filaments: Cross-sectional profile | Ratio $R_2/R_1$ | Ratio $R_1/R_0$ | Maximum take-up amount (kg) | Textured filament: Total percentage crimp (TC) (*1) (%) | Number of fluffs per chese | Fabric: Degree of appearance of glitter (*2) (class) | Degree of pastel shade (*3) (class) |
|---|---|---|---|---|---|---|---|---|---|
| | 4 | Circular | — | — | 8 | 38 | 3–5 | 1 | 3 |

(Note)
(*1) : TC was determined by the method described in U.S. Pat. No. 3,797.221
(*2) : class 5 — negligible or no glitter
class 4 — slight glitter
class 3 — little glitter
class 2 — remarkable glitter
class 1 — very remarkable glitter
(*3) : class 5 — excellent sharp color
class 4 — sharp color
class 3 — slight pastel shade
class 2 — pastel shade
class 1 — remarkable pastel shade

EXAMPLE 4, 5 and 6 AND COMPARISON EXAMPLE 5

Procedures identical to those in Example 1 were repeated except that the ratio ($R_1/R_0$) was 1.06, 1.12 and 1.15 for Examples 4, 5 and 6, respectively, and the spinning orifices has a cross-section in which eight slits extended an equal length radially with equal intervals of angle therebetween, to produce undrawn polyester multifilaments each having an octalobal cross-sectional profile as indicated in FIG. 9. The resultant textured multifilament yarns had a fineness of 150 denier/48 filaments.

In Comparison Example 5, the procedures as mentioned above were repeated except that the ratio ($R_1/R_0$) was 1.18.

The results are indicated in Table 2.

Table 2

| Example No. | | Undrawn filament: Cross-sectional profile | Ratio $R_1/R_0$ | Maximum take-up amount (kg) | Textured filament: TC (%) | Number of fluffs per chese | Fabric: Degree of appearance of glitter (class) | Degree of pastel shade (class) |
|---|---|---|---|---|---|---|---|---|
| Example | 4 | Octalobal | 1.06 | 8 | 37 | 6 | 3 | 5 |
| | 5 | " | 1.12 | 12 | 35 | 0–1 | 4.5 | 4.5 |
| | 6 | " | 1.15 | 12 | 32 | 0–1 | 5 | 4 |
| Comparison Example | 5 | Octalobal | 1.18 | 10.5 | 30 | 5–8 | 5 | 3 |

EXAMPLES 7 AND 8 AND COMPARISON EXAMPLES 6 AND 7

Procedures identical to those in Example 1 were repeated twice, except that the ratio ($R_1/R_0$) was 1.10 and 1.15 for Examples 7 and 8, respectively, and the spinning orifice consisted of seven slits extended an equal length radially with equal intervals of angle therebetween to produce undrawn polyester multifilaments each having a haptalobal cross-sectional profile as indicated in FIG. 7. The resultant textured multifilament yarns had a fineness of 150 denier/48 filaments.

In comparison Examples 6 and 7, procedures identical as mentioned above were repeated, except that the ratio ($R_1/R_0$) was 1.03 and 1.18, respectively.

The results are indicated in Table 3.

Table 3

| Example No. | | Undrawn filament: Cross-sectional profile | Ratio $R_1/R_0$ | Maximum take-up amount (kg) | Textured filament: TC (%) | Number of fluffs per chese | Fabric: Degree of appearance of glitter (class) | Degree of pastel shade (class) |
|---|---|---|---|---|---|---|---|---|
| Example | 7 | Heptalobal | 1.10 | 10 | 35 | 0–1 | 4.5 | 5 |
| | 8 | " | 1.15 | 12 | 32 | 0–1 | 5 | 4.5 |
| Comparison Example | 6 | Heptalobal | 1.03 | 6 | 37 | 6 | 2 | 5 |
| | 7 | " | 1.35 | 10.5 | 30 | 5–8 | 5 | 2 |

EXAMPLES 9 AND 10 AND COMPARISON EXAMPLES 8 THROUGH 13

A mixture of 99.7% by weight of polyethylene terephthalate having an intinsic viscosity of 0.64, which had been determined at a temperature of 35° C in o-chlorophenol, and 0.3% by weight of titanium dioxide was melted at a temperature of 290° C. The melt was extruded through a spinneret having 30 spinning orifices with six slits extending an equal length radially at equal intervals of angle therebetween of 60°. The extruded filamentary melts were solidified by cooling with cooling air and the resultant undrawn polyester multifilaments were wound up at a take-up speed of 3500 m/min on a bobbin at a traverse of 150 mm. The above-mentioned procedures were repeated in the ratios ($R_1/R_0$) of 1.06 and 1.15 for Examples 9 and 10, respectively. Undrawn polyester multifilaments having a hexalobal cross-sectional profiles indicated in FIG. 1 were obtained. The undrawn multifilaments were simultaneously drawn and textured under the following conditions.

Draw ratio : 1.48
Heat-setting temperature : 195° C
Twist number : 2550 turns/m
Processing speed : 180 m/min.

The resultant textured yarn had a denier of 150/30 filaments.

In comparison Examples 8, 9 and 10, the above-mentioned operations were repeated in the ratio ($R_1/R_0$) of 1.03, 1.25 and 1.35.

Undrawn multifilaments having a trilobal cross-sectional profile (Comparison Example 11), a cross-shaped cross-sectional profile (Comparison Example 12) and a round cross-sectional profile (Comparison Example 13) were prepared and, thereafter, converted to textured multifilaments by operations similar to those in Example 9.

The textured multifilaments were converted into a knitted fabric and dyed dark blue in the same manner as in Example 1.

The results are indicated in Table 4.

Table 4

| Example No. | | Undrawn filament: Cross-sectional profile | Ratio $R_1/R_0$ | Maximum take-up amount (kg) | Textured filament: TC (%) | Uniformity in cross-section | Fabric: Degree of appearance of glitter (class) | Degree of pastel shade (class) | Touch and feel |
|---|---|---|---|---|---|---|---|---|---|
| Example | 9 | Hexalobal | 1.06 | 10 | 35 | uniform | 3.5 | 5 | good |
| | 10 | " | 1.15 | 12 | 35 | " | 5 | 4.5 | good |
| Comparison Example | 8 | Hexalobal | 1.03 | 7 | 35 | uniform | 1 | 5 | slightly varied |
| | 9 | " | 1.25 | 12 | 34 | " | 5 | 3.5 | good |
| | 10 | " | 1.35 | 10 | 28 | varied | 5 | 2 | slightly stiff |
| | 11 | Trilobal | 2.40 | — | 24 | remarkably varied | 2 | 1 | " |
| | 12 | Cross-shaped | 1.60 | — | 26 | " | 3.5 | 1.5 | rough |
| | 13 | Round | 1.00 | — | 36 | " | 1 | 3 | very rough |

What we claim is:

1. A polyester multifilament feed yarn, comprising a plurality of undrawn polyester filaments each having a multilobal cross sectional profile having 5 to 10 lobes projected radially with substantially equal angular intervals therebetween about the center of the filament, said cross sectional profile satisfying the following relationship (1):

$$1.05 \leqq R_1/R_0 \leqq 1.16 \quad 1$$

wherein $R_0$ represents the radius of an imaginary circle inscribed within said cross section around the center of the filament, $R_1$ represents the radius of another imaginary circle circumscribed about the tips of at least half the total number of said lobes around the center of the filament.

2. A feed yarn as claimed in claim 1, wherein said cross sectional profile has one or more lobes other than said lobes satisfying the relationship (1), and said other lobes satisfy the following relationship (2):

$$1.05 \leqq R_2/R_1 \leqq 1.20 \quad 2$$

wherein $R_1$ is as defined hereinbefore and $R_2$ represents the radius of another imaginary circle circumscribed about the tips of said other lobes around the center of filament.

3. A feed yarn as claimed in claim 1, wherein said polyester filament consists of a polyester containing at least 80% by mole of ethylene terephthalate units.

4. A feed yarn as claimed in claim 3, wherein said polyester consists essentially of polyethylene terephthalate.

5. A feed yarn as claimed in claim 1, wherein said undrawn polyester filaments are prepared by melt-spinning at a take-up speed of 2500 to 4000 m/min.

6. A feed yarn as claimed in claim 1, wherein said undrawn polyester filaments have an elongation at break of 90 to 230%.

7. A feed yarn as claimed in claim 1, wherein said polyester filaments contain therein a delustering agent.

8. A feed yarn as claimed in claim 7, wherein said delustering agent consists essentially of titanium dioxide.

9. A feed yarn as claimed in claim 7, wherein said delustering agent is present in an amount of 0.05 to 0.35% based on the weight of said polyester fiber.

10. A feed yarn as claimed in claim 1, wherein the number of said lobes is 8 and said $R_0$ and $R_1$ satisfy the following relationship:

$$1.10 \leqq R_1/R_0 \leqq 1.16.$$

11. A feed yarn as claimed in claim 1, wherein the number of said lobes is 7 and said $R_0$ and $R_1$ satisfy the following relationship:

$$1.05 \leqq R_1/R_0 \leqq 1.16.$$

12. A feed yarn as claimed in claim 1, wherein the number of said lobes is 6 and said $R_0$ and $R_1$ satisfy the following relationship:

$$1.06 \leqq R_1/R_0 \leqq 1.16.$$

13. A feed yarn as claimed in claim 1, wherein said undrawn polyester filaments each has a denier of 2.5 to 9.0.

14. A feed yarn as claimed in claim 1, wherein said feed yarn has a total denier of 40 to 450.

* * * * *

UNITED STATES PATENT OFFICE
CERTIFICATE OF CORRECTION

Patent No. 4,058,967 Dated November 22, 1977

Inventor(s) Hiroyuki Iimuro, et al

It is certified that error appears in the above-identified patent and that said Letters Patent are hereby corrected as shown below:

Column 1, line 31: Change "fabric" to --fabrics--.

Column 2, line 12: Change "of" (2nd occurrence) to --or--.

line 41: Change "higher" to --angular--.

line 42: After "cross-sectional" insert --profile--.

Column 6, line 47: Change "a" to --an--.

Column 9, line 36: Change "has" to --have--.

Column 10, line 40: Change "intinsic" to --intrinsic--.

Column 12, line 42: Delete "is" after "agent"; insert --is-- after "present".

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*